US010311787B2

(12) United States Patent
Zhou et al.

(10) Patent No.: US 10,311,787 B2
(45) Date of Patent: Jun. 4, 2019

(54) PIXEL DRIVING CIRCUIT, DRIVING METHOD, PIXEL UNIT, AND DISPLAY APPARATUS

(71) Applicants: BOE TECHNOLOGY GROUP CO., LTD., Beijing (CN); HEFEI XINSHENG OPTOELECTRONICS TECHNOLOGY CO., LTD., Anhui (CN)

(72) Inventors: Maoxiu Zhou, Beijing (CN); Haipeng Yang, Beijing (CN); Ke Dai, Beijing (CN); Yongjun Yoon, Beijing (CN); Zhou Rui, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 104 days.

(21) Appl. No.: 15/724,597

(22) Filed: Oct. 4, 2017

(65) Prior Publication Data

US 2018/0166011 A1 Jun. 14, 2018

(30) Foreign Application Priority Data

Dec. 8, 2016 (CN) ..... 2016 1 1121450

(51) Int. Cl.
*G09G 3/3233* (2016.01)
*G09G 3/3266* (2016.01)
(Continued)

(52) U.S. Cl.
CPC ..... *G09G 3/3233* (2013.01); *G09G 3/3225* (2013.01); *G09G 3/3266* (2013.01);
(Continued)

(58) Field of Classification Search
CPC .. G09G 3/3233; G09G 3/3225; G09G 3/3241; G09G 3/325; G09G 3/3266;
(Continued)

(56) References Cited

U.S. PATENT DOCUMENTS 8,384,632 B2 2/2013 Chiou
10,056,037 B1 * 8/2018 Nie ..... H01L 27/3248
(Continued)

FOREIGN PATENT DOCUMENTS

CN 1773592 A 5/2006
CN 103021338 A 4/2013
(Continued)

OTHER PUBLICATIONS

First Office Action for Chinese Application No. 201611121450.1, dated May 9, 2018, 10 Pages.

*Primary Examiner* — Tom V Sheng
(74) *Attorney, Agent, or Firm* — Brooks Kushman P.C.

(57) ABSTRACT

The present disclosure provides a pixel driving circuit, a driving method, a pixel unit, and a display apparatus. The pixel driving circuit includes a driving transistor, a charging/discharging circuitry, a light-emitting control circuitry, a data write-in control circuitry, and a charging/discharging control circuitry, where a first electrode of the charging/discharging circuitry is connected to a second electrode of the driving transistor, and the charging/discharging control circuitry is configured to enable a first electrode of the driving transistor to be electrically connected to a second level output terminal under the control of a data line, and enable a second terminal of the charging/discharging circuitry to be electrically connected to a gate electrode of the driving transistor under the control of a first scan line.

17 Claims, 3 Drawing Sheets

(51) Int. Cl.
*G09G 3/3291* (2016.01)
*G09G 3/3225* (2016.01)

(52) U.S. Cl.
CPC ... *G09G 3/3291* (2013.01); *G09G 2300/0814* (2013.01); *G09G 2300/0819* (2013.01); *G09G 2300/0842* (2013.01); *G09G 2310/0248* (2013.01); *G09G 2310/08* (2013.01); *G09G 2320/0233* (2013.01); *G09G 2330/021* (2013.01)

(58) Field of Classification Search
CPC ..... G09G 3/3291; G09G 2300/0814; G09G 2300/0819; G09G 2300/0842; G09G 2310/0248; G09G 2310/08; G09G 2320/0233; G09G 2330/021
See application file for complete search history.

(56) References Cited

U.S. PATENT DOCUMENTS

2006/0103606 A1 5/2006 Ahn et al.
2007/0040769 A1* 2/2007 Tai ..... G09G 3/3233 345/76
2008/0143648 A1* 6/2008 Ishizuka ..... G09G 3/325 345/76
2011/0057919 A1* 3/2011 Kim ..... G09G 3/3233 345/211
2011/0157135 A1* 6/2011 Lee ..... G09G 3/3291 345/211
2012/0293479 A1* 11/2012 Han ..... G09G 3/003 345/212
2014/0118321 A1* 5/2014 Kim ..... G09G 3/22 345/212
2014/0152191 A1* 6/2014 Yang ..... G09G 3/3233 315/240
2015/0077010 A1 3/2015 Tai et al.
2016/0019841 A1* 1/2016 Woo ..... G09G 3/3233 345/204
2016/0103513 A1* 4/2016 Yang ..... G06F 3/041 345/175
2016/0104421 A1* 4/2016 Park ..... G09G 3/3233 345/212
2016/0140900 A1* 5/2016 Yang ..... G09G 3/3258 345/206
2016/0171930 A1* 6/2016 Song ..... G09G 3/3225 345/690
2016/0224157 A1* 8/2016 Yang ..... G09G 3/3233
2016/0274692 A1* 9/2016 Yang ..... G06F 3/044
2016/0291743 A1* 10/2016 Yang ..... G09G 3/3258
2016/0379560 A1* 12/2016 Cho ..... G09G 3/3233 345/76
2016/0379571 A1* 12/2016 Kim ..... G09G 3/3233 345/215
2017/0162113 A1* 6/2017 Lin ..... G09G 3/3233
2017/0168646 A1* 6/2017 Yang ..... G06F 3/0412
2017/0193919 A1* 7/2017 Hwang ..... G09G 3/325
2018/0047336 A1* 2/2018 Chen ..... G09G 3/3266
2018/0090072 A1* 3/2018 Sun ..... G09G 3/3258
2018/0114487 A1 4/2018 He et al.
2018/0174512 A1* 6/2018 Yuan ..... G09G 3/32
2018/0240410 A1* 8/2018 Yang ..... G09G 3/3266
2018/0261663 A1* 9/2018 Li ..... G09G 3/3225

FOREIGN PATENT DOCUMENTS

CN 2022905119 U 4/2013
CN 203503280 U 3/2014
CN 104464655 A 3/2015
CN 104867441 A 8/2015
CN 105609050 A 5/2016
CN 105761676 A 7/2016
CN 206249669 U 6/2017

* cited by examiner

PIXEL DRIVING CIRCUIT, DRIVING METHOD, PIXEL UNIT, AND DISPLAY APPARATUS

CROSS-REFERENCE TO RELATED APPLICATION

This application claims priority to Chinese Patent Application No. 201611121450.1, filed on Dec. 8, 2016, the disclosure of which is incorporated in its entirety by reference herein.

TECHNICAL FIELD

The present disclosure relates to the field of pixel driving technology, and in particular to a pixel driving circuit, a driving method, a pixel unit, and a display apparatus.

BACKGROUND

A threshold voltage of a driving TFT (Thin Film Transistor) of a pixel driving circuit included in a display device may be shifted due to process deviation, so as to cause non-uniformity in driving electric currents of various pixels. In a related art, a pixel driving circuit may not save space for a circuit design while eliminating threshold voltage deviation due to the process deviation. Accordingly, a pixel aperture ratio may not be readily increased and the number of signal lines may not be readily decreased, thereby resulting in a complex design and a high cost of the circuit.

SUMMARY

A main object of the present disclosure is to provide a pixel driving circuit, a driving method, a pixel unit, and a display apparatus.

The present disclosure provides a pixel driving circuit, which includes: a driving transistor including a first electrode connected to a light emitting component; a driving transistor, a first electrode of which is connected to a light emitting component; a charging/discharging circuitry, a first terminal of which is connected to a second electrode of the driving transistor; a light-emitting control circuitry, connected to a first scan line, the second electrode of the driving transistor, and a first level output terminal, and configured to enable the second electrode of the driving transistor to be electrically connected to the first level output terminal under the control of the first scan line; a data write-in control circuitry, connected to a data line, a second scan line, and a gate electrode of the driving transistor, and configured to enable the gate electrode of the driving transistor to be electrically connected to the data line under the control of the second scan line; and a charging/discharging control circuitry, connected to the data line, the first electrode of the driving transistor, a second level output terminal, the first scan line, a second terminal of the charging/discharging circuitry, and the gate electrode of the driving transistor, and configured to enable the first electrode of the driving transistor to be electrically connected to the second level output terminal under the control of the data line, and enable the second terminal of the charging/discharging circuitry to be electrically connected to the gate electrode of the driving transistor under the control of the first scan line.

In a possible embodiment of the present disclosure, a working cycle of the pixel driving circuit includes a charging phase, a circuit adjustment phase, and a light-emitting phase, and wherein the charging/discharging control circuitry is further configured to control the first electrode of the driving transistor to be electrically connected to the second level output terminal during the circuit adjustment phase under the control of the data line, and to control the second terminal of the charging circuitry to be electrically connected to the gate electrode of the driving transistor during both the charging phase and the light-emitting phase under the control of the first scan line.

In a possible embodiment of the present disclosure, the light-emitting control circuitry is further configured to control the second electrode of the driving transistor to be electrically connected to the first level output terminal during both the charging phase and the light-emitting phase under the control of the first scan line, and wherein the data write-in control circuitry is further to control the gate electrode of the driving transistor to be electrically connected to the data line during both the charging phase and the circuit adjustment phase under the control of the second scan line.

In a possible embodiment of the present disclosure, the light-emitting control circuitry includes a light-emitting control transistor, a gate electrode of which is connected to the first scan line, a first electrode of which is connected to the first electrode of the driving transistor, and a second electrode of which is connected to the first level output terminal.

In a possible embodiment of the present disclosure, the data write-in control circuitry includes a data write-in control transistor, a gate electrode of which is connected to the second scan line, a first electrode of which is connected to the data line, and a second electrode of which is connected to the gate electrode of the driving transistor.

In a possible embodiment of the present disclosure, the charging/discharging control circuitry includes: a first charging/discharging control transistor, a gate electrode of which is connected to the data line, a first electrode of which is connected to the second level output terminal, and a second electrode of which is connected to the first electrode of the driving transistor; and a second charging/discharging control transistor, a gate electrode of which is connected to the first scan line, a first electrode of which is connected to the gate electrode of the driving transistor, and a second electrode of which is connected to the second terminal of the charging/discharging circuitry.

Further, the charging/discharging circuitry includes a storage capacitor, the storage capacitor, a first terminal of which is connected to the second electrode of the driving transistor and a second terminal of which is connected to the second electrode of the second charging/discharging control transistor. Further, the light-emitting control circuitry includes a light-emitting control transistor, a gate electrode of which is connected to the first scan line, a first electrode of which is connected to the first electrode of the driving transistor, and a second electrode of which is connected to the first level output terminal, and the data write-in control circuitry includes a data write-in control transistor, a gate electrode of which is connected to the second scan line, a first electrode of which is connected to the data line, and a second electrode of which is connected to the gate electrode of the driving transistor.

In a possible embodiment of the present disclosure, the charging/discharging circuitry includes a storage capacitor, a first terminal of which is connected to the second electrode of the driving transistor and a second terminal of which is connected to the charging/discharging control circuitry.

The present disclosure provides a driving method, which is applied to any one of the pixel driving circuits described herein, where a working cycle of the pixel driving circuit includes a charging phase, a circuit adjustment phase, and a light-emitting phase. The method includes following procedures: during the charging phase, controlling, by the light-emitting control circuitry, the first electrode of the driving transistor to be electrically connected to the first level output terminal under the control of the first scan line, controlling, by the data write-in control circuitry, the gate electrode of the driving transistor to be electrically connected to the data line under the control of the second scan line, outputting, by the data line, a third level so as to turn off the driving transistor, and controlling, by the charging/discharging control circuitry, the second terminal of the charging/discharging circuitry be electrically connected to the gate electrode of the driving transistor under the control of the first scan line; during the circuit adjustment phase, outputting, by the data line, a data voltage, controlling, by the data write-in control circuitry, the gate electrode of the driving transistor to be electrically connected to the data line under the control of the second scan line, and controlling, by the charging/discharging control circuitry, the first electrode of the driving transistor to be electrically connected to the second level output terminal under the control of the data voltage, so as to turn on the driving transistor until the charging/discharging circuitry discharges, such that a potential difference between a voltage at the first terminal of the charging/discharging circuitry and a voltage at the second terminal of the charging/discharging circuitry is a sum of the data voltage and a threshold voltage of the driving transistor; and during the light-emitting phase, controlling, by the light-emitting control circuitry, the first electrode of the driving transistor to be electrically connected to the first level output terminal, and controlling, by the charging/discharging control circuitry, the second terminal of the charging/discharging circuitry to be electrically connected to the gate electrode of the driving transistor under the control of the first scan line, so as to maintain a gate voltage of the driving transistor at the sum of the data voltage and the threshold voltage of the driving transistor, such that the driving transistor is turned on to compensate for the threshold voltage of the driving transistor by controlling the gate voltage of the driving transistor.

In a possible embodiment of the present disclosure, the third level is determined according to the first level and the threshold voltage of the driving transistor.

In a possible embodiment of the present disclosure, in the case that the driving transistor is an n-type transistor, a difference between the third level and the first level is smaller than the threshold voltage of the driving transistor so as to turn off the driving transistor during the charging phase.

In a possible embodiment of the present disclosure, in the case that the driving transistor is a p-type transistor, a difference between the third level and the first level is greater than the threshold voltage of the driving transistor so as to turn off the driving transistor during the charging phase.

In a possible embodiment of the present disclosure, the driving method includes following procedures: during the charging phase, outputting, by the data line, a low level, outputting, by the first scan line, a high level, and outputting, by the second scan line, a high level, so as to turn on the light-emitting control transistor, the data write-in control transistor, and the second charging/discharging control transistor, and turn off the driving transistor and the first charging/discharging control transistor; during the circuit adjustment phase, outputting, by the data line, a high level, outputting, by the first scan line, a low level, and outputting, by the second scan line, a high level, so as to turn off the light-emitting control transistor and the second charging/discharging control transistor, and turn on the data write-in control transistor, the driving transistor, and the first charging/discharging control transistor; and during the light-emitting phase, outputting, by the data line, a low level, outputting, by the first scan line, a high level, and outputting, by the second scan line, a low level, so as to turn off the data write-in control transistor and the first charging/discharging control transistor, and so as to turn on the light-emitting control transistor, the driving transistor, and the second charging/discharging control transistor.

In a possible embodiment of the present disclosure, during the circuit adjustment phase, a low level output from the first scan line is greater than a reverse breakdown voltage of the light-emitting control transistor, and is smaller than a voltage difference between the threshold voltage of the light-emitting control transistor and a turn-off voltage of the light-emitting control transistor, a high level output from the second scan line is between a data voltage corresponding to a lowest brightness value and a data voltage corresponding to a highest brightness value.

The present disclosure also provides a pixel unit, which includes a light emitting component and any one of pixel driving circuits described herein, the pixel driving circuit being connected to the light emitting component and configured to drive the light emitting component to emit light.

The present disclosure also provides a display apparatus including any one of the pixel units described herein.

BRIEF DESCRIPTION OF THE DRAWINGS

In order to more clearly explain the technical solutions of embodiments of the present disclosure, the drawings to be used in the descriptions of the embodiments are briefly introduced as follows. Apparently, the following drawings merely illustrate some embodiments of the present disclosure, and a person skilled in the art can obtain other drawings from these drawings without any creative effort.

DETAILED DESCRIPTION

The present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Figure 1:
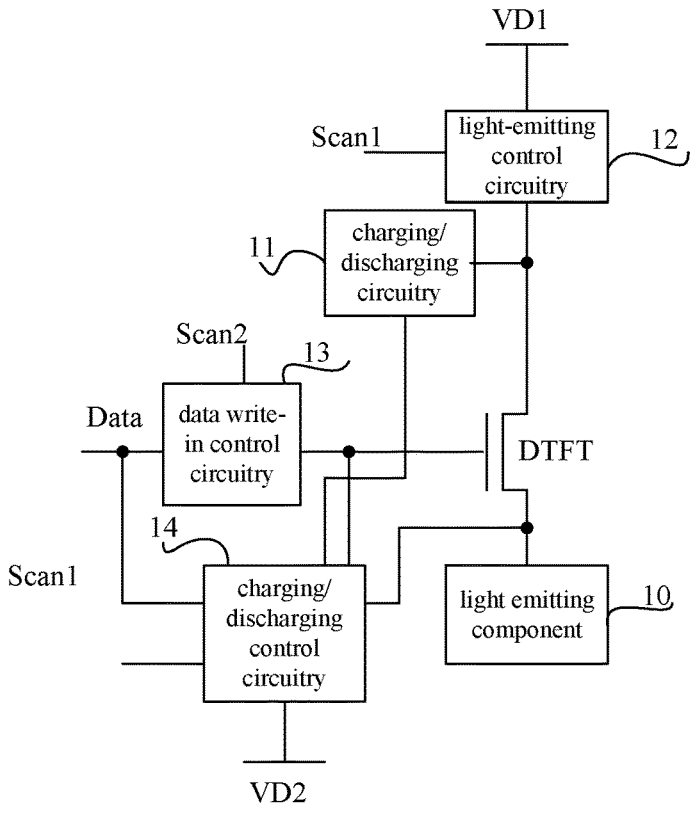
FIG. 1 is a structural diagram of a pixel driving circuit according to some embodiment of the present disclosure.

As shown in FIG. 1, a pixel driving circuit according to embodiment(s) of the present disclosure includes a driving transistor DTFT, a charging/discharging circuitry 11, a light-emitting control circuitry 12, a data write-in control circuitry 13, and a charging/discharging control circuitry 14.

The driving transistor DTFT includes a first electrode connected to a light emitting component 10.

The charging/discharging circuitry 11 includes a first terminal connected to a second electrode of the driving transistor DTFT.

The light-emitting control circuitry 12 is connected to a first scan line ("Scan1"), a second electrode of the driving transistor DTFT, and a first level output terminal VD1 of, so as to enable the second electrode of the driving transistor DTFT to be electrically connected to the first level output terminal VD1 under the control of the first scan line Scan1. For instance, the light-emitting control circuitry 12 may be configured to enable the second electrode of the driving transistor DTFT to be electrically connected to the first level output terminal VD1 under the control of the first scan line Scan 1 during a charging phase and a light-emitting phase.

The data write-in control circuitry 13 is connected to a data line ("Data"), a second scan line ("Scan2"), and a gate electrode of the driving transistor DTFT, so as to enable the gate electrode of the driving transistor DTFT to be electrically connected to the data line "Data" under the control of the second scan line Scan2. For instance, the data write-in control circuitry 13 may be configured to enable the gate electrode of the driving transistor DTFT to be electrically connected to the data line Data under the control of the second scan line Scan2 during a charging phase and a circuit adjustment phase.

The charging/discharging control circuitry 14 is connected to the data line Data, a first electrode of the driving transistor DTFT, a second level output terminal VD2 of, the first scan line Scan1, a second terminal of a charging/discharging circuitry 11, and the gate electrode of the driving transistor DTFT. The charging/discharging control circuitry 14 may be configured to enable the first electrode of the driving transistor DTFT to be electrically connected to the second level output terminal VD2 under the control of the data line Data, and to enable the second terminal of the charging/discharging circuitry 11 to be electrically connected to the gate electrode of the driving transistor DTFT under the control of the first scan line Scan1. For instance, the charging/discharging control circuitry 14 may be configured to enable the first electrode of the driving transistor DTFT to be electrically connected to the second level output terminal VD2 under the control of the data line "Data" during the circuit adjustment phase, and to enable the second terminal of the charging/discharging circuitry 11 to be electrically connected to the gate electrode of the driving transistor DTFT under the control of the first scan line "Scan1" during a charging phase and a light-emitting phase.

In FIG. 1, DTFT is for example an n-type transistor, or DTFT may also be a p-type transistor in an actual operation. The driving transistor is not limited to any particular type herein.

The pixel driving circuit according to the embodiment(s) of the present disclosure may eliminate threshold voltage shift due to process deviation, so as to increase a pixel aperture ratio and reduce the number of signal lines. Hence, the space for a circuit design is saved while addressing a picture quality issue due to lack of uniformity in a current, thereby lowering the cost of the circuit and facilitating the circuit design.

In comparison to a traditional pixel driving circuit, in a pixel driving circuit according to some embodiment of the present disclosure, the data line Data directly controls a transistor included in a charging/discharging control circuitry. In particular, during the circuit adjustment phase (i.e., a data voltage write-in phase), the electrical connection between the first electrode of the driving transistor DTFT and the second level output terminal VD2 may be realized via a control of the data line Data by turning on the driving transistor. Via a direct control of turning-on and turning-off of the control transistor by the data line Data, and via collaboration of the first scan line Scan1 and the second scan line Scan2, total number of signal lines may be reduced, and accordingly circuit cost may be lowered and circuit design may be simplified.

In particular, the light-emitting control circuitry may include a light-emitting control transistor. The gate electrode of the light-emitting control transistor is connected to the first scan line, the first electrode of the light-emitting control transistor is connected to the first electrode of the driving transistor, and the second electrode of the light-emitting control transistor is connected to the first level output terminal.

In particular, the data write-in control circuitry includes a data write-in control transistor. A gate electrode of the data write-in control transistor is connected to the second scan line, a first electrode of the data write-in control transistor is connected to the data line, and a second electrode of the data write-in transistor is connected to the gate electrode of the driving transistor.

In particular, the charging/discharging control circuitry may include a first charging/discharging control transistor and a second charging/discharging control transistor. The first charging/discharging transistor includes a gate electrode connected to the data line, a first electrode connected to an output terminal of the second level, and a second electrode connected to the first electrode of the driving transistor. The second charging/discharging control transistor includes a gate electrode connected to the first scan line, a first electrode connected to the gate electrode of the driving transistor, and a second electrode connected to a second terminal of the charging/discharging circuitry.

In particular, the charging/discharging circuitry may include a storage capacitor, wherein the storage capacitor includes a first terminal connected to the second electrode of the driving transistor, and a second terminal connected to the charging/discharging control circuitry. Optionally, the second terminal of the storage capacitor is connected to the second electrode of the second charging/discharging control transistor included in the charging/discharging control circuitry.

In an actual operation, in the case that the DTFT and all circuitry transistors in the circuitries are n-type transistors, the first level output terminal VD1 outputs a high level "Vdd," where Vdd≥Vdh, and where Vdh is a data voltage corresponding to the highest brightness value, the second level output terminal VD2 is a ground terminal GND.

Figure 2:
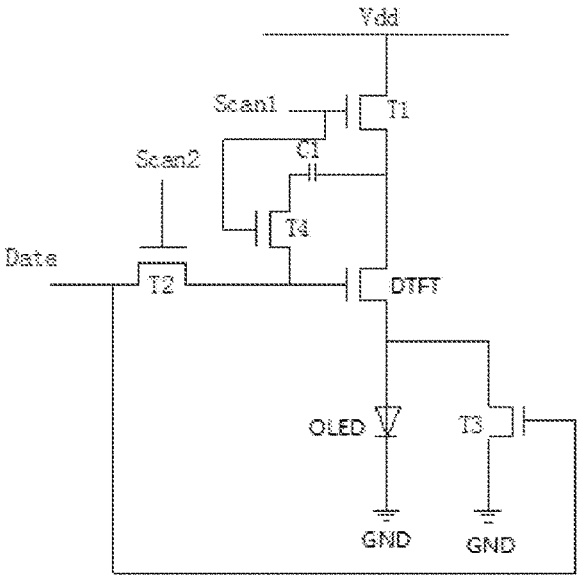
FIG. 2 is a particular circuit diagram of a pixel driving circuit according to some embodiment of the present disclosure.

As shown in FIG. 2, and in some embodiments, the pixel driving circuit of the present disclosure may be configured to drive an organic light emitting diode ("OLED") to emit light. The pixel driving circuit according a certain particular embodiment includes a driving transistor DTFT, a charging/discharging circuitry, a light-emitting control circuitry, a data write-in control circuitry, and a charging/discharging control circuitry. A source electrode of the driving transistor DTFT is connected to an anode of the organic light emitting diode OLED, and a cathode of the organic light emitting diodes OLED is connected to a ground terminal ("GND"). The charging/discharging circuitry includes a storage capacitor ("C1"), a first terminal of the storage capacitor C1 is connected to a drain electrode of the driving transistor DTFT. The light-emitting control circuitry includes a light-emitting control transistor T1, a gate electrode of which is connected to the first scan line Scan1, a source electrode of which is connected to a drain electrode of the driving transistor DTFT, and the drain electrode of which is connected to a high level Vdd. The data write-in control circuitry includes a data write-in control circuitry T2, a gate electrode of which is connected to the second scan line Scan2, a source electrode of which is connected to the data line Data, and a drain electrode of which is connected to the gate electrode of the driving electrode DTFT. The charging/discharging control circuitry includes: a first charging/discharging control transistor T3, a gate electrode of which is connected to the data line Data, a source electrode of which is connected to the ground terminal GND, a drain electrode of which is connected to a source electrode of the driving transistor DTFT; and a second charging/discharging control transistor T4, a gate electrode of which is connected to the first scan line Scan1, a source electrode of which is connected to a gate electrode of the driving transistor DTFT, and a drain electrode of which is connected to the second terminal of the storage capacitor C1.

Figure 3:
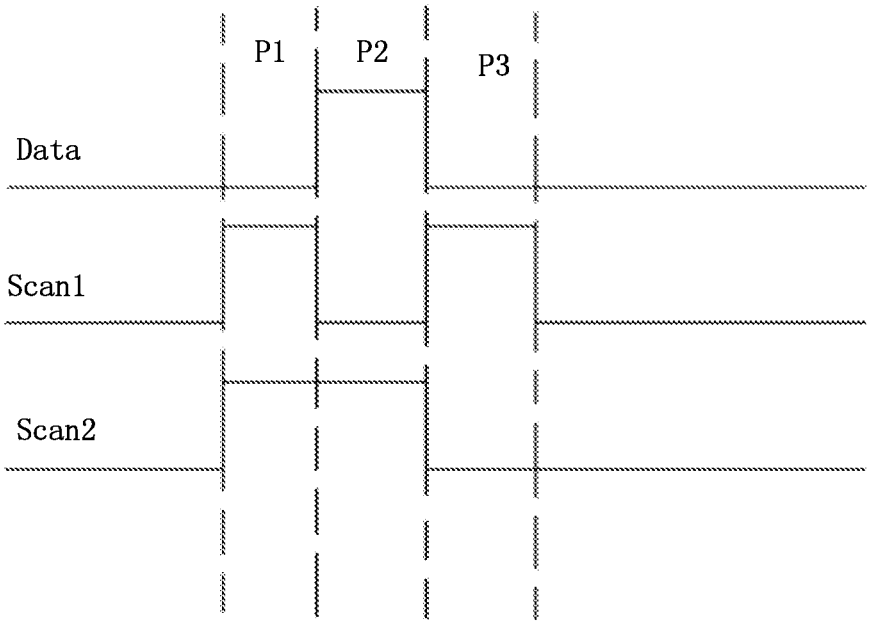
FIG. 3 is a timing diagram illustrating an operation of the pixel driving circuit of FIG. 2 according to some embodiment of the present disclosure.

In some embodiments, FIG. 3 is a possible timing diagram illustrating an operation of the pixel driving circuit shown in FIG. 2. The timing diagram shows a cycle of three phases, namely a charging phase P1, a circuit adjustment phase P2, and a light-emitting phase P3.

Figure 4A:
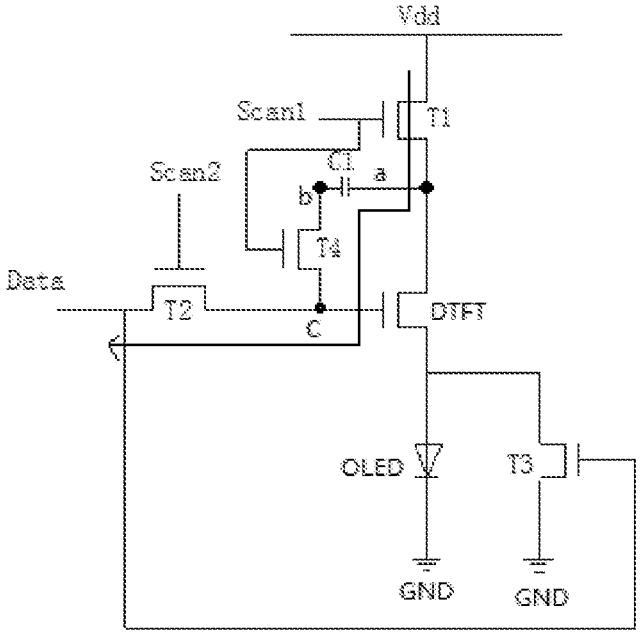
FIG. 4A is schematic view illustrating a current direction during a charging phase P1 of the pixel driving circuit of FIG. 2 according to some embodiment of the present disclosure.

During the charging phase P1, Scan1 and Scan2 both output high level, Data outputs a data voltage of zero, T1, T2 and T4 are on, and DTFT and T3 are off. At this time, as shown in FIG. 4A, T1, C1, T4, and T2 collectively form a charging circuit, with a current direction indicated by an arrow depicted in FIG. 4A, where a voltage Va at node a is changed to Vdd, where the node a is a first node connected to the first terminal of C1, and where a voltage Vb at node b is zero, where the node b is a second node connected to the second terminal of C1.

Figure 4B:
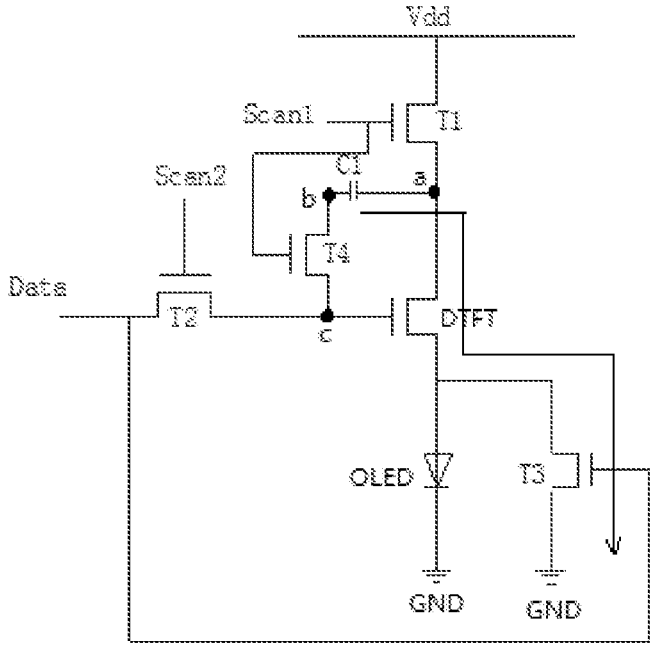
FIG. 4B is schematic view illustrating a current direction during a circuit adjustment phase P2 of the pixel driving circuit of FIG. 2 according to some embodiment of the present disclosure.

During the circuit adjustment phase P2, Scan 1 outputs a low voltage Vscan1 so as to turn off T1, where V1<Vscan1<V2, where V1 is a reverse breakdown voltage, and V2 is the difference between T1's threshold voltage Vth and T1's turned-off voltage. Also during the circuit adjustment phase P2, Scan2 outputs a high level Vscan2 so as to turn on T2, and Data outputs Vdata which is high level, where the high voltage Vscan is between a data voltage corresponding to the lowest brightness value and a data voltage Vdh corresponding to the highest brightness value. At this point of time, T1 and T4 are off, T2, DTFT and T3 are all on, C1 may discharge, a direction of a discharge path may be indicated by the arrow shown in FIG. 4B. by discharging through C1, DTFT and T3, in the case that the voltage Va at the node a drops to Vdata+Vth, C1 stops discharging, and Va−Vb=Vdata+Vth.

Figure 4C:
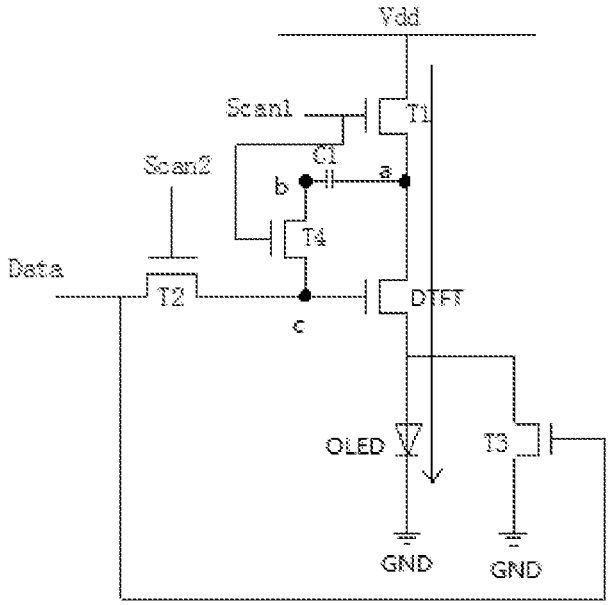
FIG. 4C is schematic view illustrating a current direction during a light-emitting phase P3 of the pixel driving circuit of FIG. 2 according to some embodiment of the present disclosure.

During the circuit light-emitting phase P3, Scan1 outputs a high level so as to turn on T1, and Scan 2 outputs a low level so as to turn off T2, and Data outputs a data voltage of zero. At this point of time, and as shown in FIG. 4C, T1, T4 and DTFT are all on, T2 and T3 are both off, a voltage Vc at a node c and a voltage Vb at a node b are the same, where the node c is a third node connected to the gate electrode of DTFT, and a voltage difference between the voltage at the node a and the voltage at the node c is maintained at Vdata+Vth. Accordingly at this point of time, a gate voltage Vgs of DTFT is maintained at Vdata+Vth, a driving current running through DTFT is I=K×(Vgs−Vth) 2=K×Vdata2, and OLED is maintained at a constant current to emit light and not to be affected by the threshold voltage Vth of DFTT, where K is a current coefficient of DTFT.

A driving method for the pixel driving circuit according to some embodiment of the present disclosure may be employed in the above-detailed pixel driving circuit. Each display cycle includes a charging phase, a circuit adjustment phase, and a light-emitting phase, and the driving method of the pixel driving circuit includes following procedures. During the charging phase, the data line outputs the third level, the light-emitting control circuitry enables the first electrode of the driving transistor to be electrically connected to the first level output terminal under the control of the first scan line, the data write-in control circuitry enables the gate electrode of the driving transistor to be electrically connected to the data line under the control of the second scan line, and the charging/discharging control circuitry enables the second terminal of the charging/discharging circuitry to be electrically connected to the gate electrode of the driving transistor under the control of the first scan line; during the circuit adjustment phase, the data line outputs the data voltage Vdata, the data write-in control circuitry enables the gate electrode of the driving transistor to be electrically connected to the data line under the control of the second scan line, and the charging/discharging control circuitry enables the first electrode of the driving transistor to be electrically connected to the second level output terminal under the control of the data voltage, so as to turn on the driving transistor until the charging/discharging circuitry discharges such that a voltage difference between the voltage at the first terminal of the charging/discharging circuitry and the voltage at the second terminal of the charging/discharging circuitry is the sum of the data voltage Vdata and the threshold voltage Vth of the driving transistor; and during the light-emitting phase, the light-emitting control circuitry enables the first electrode of the driving transistor to be electrically connected to the first level output terminal, the charging/discharging circuitry enables the second terminal of the charging/discharging circuitry to be electrically connected to the gate electrode of the driving transistor under the control of the first scan line, so as to keep the gate voltage of the driving transistor to be at Vdata+Vth, such that the driving transistor is turned on to compensate for the threshold voltage of the driving transistor by controlling the gate voltage of the driving transistor.

In actual operations, in the case that the driving transistor is an n-type transistor, a difference between the third level and the first level is smaller than the threshold voltage of the driving transistor, so as to confirm that the driving transistor is turned off during the charging phase, where the first level is output from the first level output terminal.

In actual operations, in the case that the driving transistor is a p-type transistor, a difference between the third level and the first level is greater than the threshold voltage of the driving transistor, so as to confirm that the driving transistor is turned off during the charging phase, where the first level is output from the first level output terminal.

A pixel unit according to some embodiment of the present disclosure includes a light emitting component and the pixel driving circuit described above, where the pixel driving circuit is connected to the light emitting component and configured to drive the light emitting component to emit light.

A display apparatus according to some embodiment of the present disclosure includes the pixel unit described above. In actual operations, the display apparatus may be any apparatus that is able to display, and in particular may be a display panel.

The above are merely the preferred embodiments of the present disclosure. It should be appreciated that, a person skilled in the art may make further modifications and improvements without departing from the principle of the present disclosure, and these modifications and improvements shall also fall within the scope of the present disclosure.

What is claimed is:

1. A pixel driving circuit, comprising:

a driving transistor, a first electrode of which is connected to a light emitting component;

a charging/discharging circuitry, a first terminal of which is connected to a second electrode of the driving transistor;

a light-emitting control circuitry, connected to a first scan line, the second electrode of the driving transistor, and a first level output terminal, and configured to enable the second electrode of the driving transistor to be electrically connected to the first level output terminal under the control of the first scan line;

a data write-in control circuitry, connected to a data line, a second scan line, and a gate electrode of the driving transistor, and configured to enable the gate electrode of the driving transistor to be electrically connected to the data line under the control of the second scan line; and a charging/discharging control circuitry, connected to the data line, the first electrode of the driving transistor, a second level output terminal, the first scan line, a second terminal of the charging/discharging circuitry, and the gate electrode of the driving transistor, and configured to enable the first electrode of the driving transistor to be electrically connected to the second level output terminal under the control of the data line, and enable the second terminal of the charging/discharging circuitry to be electrically connected to the gate electrode of the driving transistor under the control of the first scan line.

2. The pixel driving circuit of claim 1, wherein a working cycle of the pixel driving circuit comprises a charging phase, a circuit adjustment phase, and a light-emitting phase, and wherein the charging/discharging control circuitry is further configured to control the first electrode of the driving transistor to be electrically connected to the second level output terminal during the circuit adjustment phase under the control of the data line, and to control the second terminal of the charging circuitry to be electrically connected to the gate electrode of the driving transistor during both the charging phase and the light-emitting phase under the control of the first scan line.

3. The pixel driving circuit of claim 2, wherein the light-emitting control circuitry is further configured to control the second electrode of the driving transistor to be electrically connected to the first level output terminal during both the charging phase and the light-emitting phase under the control of the first scan line, and wherein the data write-in control circuitry is further to control the gate electrode of the driving transistor to be electrically connected to the data line during both the charging phase and the circuit adjustment phase under the control of the second scan line.

4. The pixel driving circuit of claim 1, wherein the light-emitting control circuitry includes a light-emitting control transistor, a gate electrode of which is connected to the first scan line, a first electrode of which is connected to the first electrode of the driving transistor, and a second electrode of which is connected to the first level output terminal.

5. The pixel driving circuitry of claim 1, wherein the data write-in control circuitry includes a data write-in control transistor, a gate electrode of which is connected to the second scan line, a first electrode of which is connected to the data line, and a second electrode of which is connected to the gate electrode of the driving transistor.

6. The pixel driving circuit of claim 1, wherein the charging/discharging control circuitry includes:

a first charging/discharging control transistor, a gate electrode of which is connected to the data line, a first electrode of which is connected to the second level output terminal, and a second electrode of which is connected to the first electrode of the driving transistor; and a second charging/discharging control transistor, a gate electrode of which is connected to the first scan line, a first electrode of which is connected to the gate electrode of the driving transistor, and a second electrode of which is connected to the second terminal of the charging/discharging circuitry.

7. The pixel driving circuit of claim 6, wherein the charging/discharging circuitry comprises a storage capacitor, the storage capacitor, a first terminal of which is connected to the second electrode of the driving transistor and a second terminal of which is connected to the second electrode of the second charging/discharging control transistor.

8. The pixel driving circuit of claim 7, wherein the light-emitting control circuitry comprises a light-emitting control transistor, a gate electrode of which is connected to the first scan line, a first electrode of which is connected to the first electrode of the driving transistor, and a second electrode of which is connected to the first level output terminal; and wherein the data write-in control circuitry comprises a data write-in control transistor, a gate electrode of which is connected to the second scan line, a first electrode of which is connected to the data line, and a second electrode of which is connected to the gate electrode of the driving transistor.

9. A driving method for the pixel driving circuit of claim 8, wherein a working cycle of the pixel driving circuit comprises a charging phase, a circuit adjustment phase, and a light-emitting phase, the driving transistor is an n-type transistor, and the driving method comprises:

during the charging phase, outputting, by the data line, a low level, outputting, by the first scan line, a high level, and outputting, by the second scan line, a high level, so as to turn on the light-emitting control transistor, the data write-in control transistor, and the second charging/discharging control transistor, and turn off the driving transistor and the first charging/discharging control transistor;

during the circuit adjustment phase, outputting, by the data line, a high level, outputting, by the first scan line, a low level, and outputting, by the second scan line, a high level, so as to turn off the light-emitting control transistor and the second charging/discharging control transistor, and turn on the data write-in control transistor, the driving transistor, and the first charging/discharging control transistor; and during the light-emitting phase, outputting, by the data line, a low level, outputting, by the first scan line, a high level, and outputting, by the second scan line, a low level, so as to turn off the data write-in control transistor and the first charging/discharging control transistor, and so as to turn on the light-emitting control transistor, the driving transistor, and the second charging/discharging control transistor.

10. The driving method of claim 9, wherein, during the circuit adjustment phase, a low level output from the first scan line is greater than a reverse breakdown voltage of the light-emitting control transistor, and is smaller than a voltage difference between the threshold voltage of the light-emitting control transistor and a turn-off voltage of the light-emitting control transistor, and a high level output from the second scan line is between a data voltage corresponding to a lowest brightness value and a data voltage corresponding to a highest brightness value.

11. The pixel driving circuit of claim 1, wherein the charging/discharging circuitry comprises a storage capacitor, a first terminal of which is connected to the second electrode of the driving transistor and a second terminal of which is connected to the charging/discharging control circuitry.

12. A driving method for the pixel driving circuit of claim 1, wherein a working cycle of the pixel driving circuit comprises a charging phase, a circuit adjustment phase, and a light-emitting phase, and the method comprises:

during the charging phase, controlling, by the light-emitting control circuitry, the first electrode of the driving transistor to be electrically connected to the first level output terminal under the control of the first scan line, controlling, by the data write-in control circuitry, the gate electrode of the driving transistor to be electrically connected to the data line under the control of the second scan line, outputting, by the data line, a third level so as to turn off the driving transistor, and controlling, by the charging/discharging control circuitry, the second terminal of the charging/discharging circuitry be electrically connected to the gate electrode of the driving transistor under the control of the first scan line;

during the circuit adjustment phase, outputting, by the data line, a data voltage, controlling, by the data write-in control circuitry, the gate electrode of the driving transistor to be electrically connected to the data line under the control of the second scan line, and controlling, by the charging/discharging control circuitry, the first electrode of the driving transistor to be electrically connected to the second level output terminal under the control of the data voltage, so as to turn on the driving transistor until the charging/discharging circuitry discharges, such that a potential difference between a voltage at the first terminal of the charging/discharging circuitry and a voltage at the second terminal of the charging/discharging circuitry is a sum of the data voltage and a threshold voltage of the driving transistor; and during the light-emitting phase, controlling, by the light-emitting control circuitry, the first electrode of the driving transistor to be electrically connected to the first level output terminal, and controlling, by the charging/discharging control circuitry, the second terminal of the charging/discharging circuitry to be electrically connected to the gate electrode of the driving transistor under the control of the first scan line, so as to maintain a gate voltage of the driving transistor at the sum of the data voltage and the threshold voltage of the driving transistor, such that the driving transistor is turned on to compensate for the threshold voltage of the driving transistor by controlling the gate voltage of the driving transistor.

13. The driving method of claim 12, wherein the third level is determined according to the first level and the threshold voltage of the driving transistor.

14. The driving method of claim 12, wherein, in the case that the driving transistor is an n-type transistor, a difference between the third level and the first level is smaller than the threshold voltage of the driving transistor so as to turn off the driving transistor during the charging phase.

15. The driving method of claim 12, wherein, in the case that the driving transistor is a p-type transistor, a difference between the third level and the first level is greater than the threshold voltage of the driving transistor so as to turn off the driving transistor during the charging phase.

16. A pixel unit, comprising a light emitting component and a pixel driving circuit of claim 1, wherein the pixel driving circuit is connected to the light emitting component and configured to drive the light emitting component to emit light.

17. A display apparatus, comprising a pixel unit of claim 16.

* * * * *